US005322169A

United States Patent [19]

Tils

[11] Patent Number: 5,322,169

[45] Date of Patent: Jun. 21, 1994

[54] FLOTATION CYCLONE

[75] Inventor: Henricus M. G. C. Tils, Utrecht, Netherlands

[73] Assignee: Heidemij Reststoffendiensten B.V., Arnhem, Netherlands

[21] Appl. No.: 955,887

[22] PCT Filed: Jun. 11, 1991

[86] PCT No.: PCT/NL91/00095

§ 371 Date: Feb. 16, 1993

§ 102(e) Date: Feb. 16, 1993

[87] PCT Pub. No.: WO91/19572

PCT Pub. Date: Dec. 26, 1991

[30] Foreign Application Priority Data

Jun. 15, 1990 [NL] Netherlands ..... 90201542

[51] Int. Cl.[5] ..... B03D 1/24; B04C 5/10; B04C 5/181; B04C 7/00

[52] U.S. Cl. ..... 209/170; 210/221.2; 210/512.1; 210/512.3; 261/122.1

[58] Field of Search ..... 209/211, 170; 210/221.2, 512.1, 512.3; 261/122.1

[56] References Cited

U.S. PATENT DOCUMENTS

| | | | |
|---|---|---|---|
| 2,102,525 | 12/1937 | Freeman . | |
| 3,802,570 | 4/1974 | Dehne | 210/512.1 |
| 4,094,783 | 6/1978 | Jackson | 210/221.2 |
| 4,279,743 | 7/1981 | Miller | 210/220 |
| 4,397,741 | 8/1983 | Miller . | |
| 4,744,890 | 5/1988 | Miller | 210/221.2 |
| 4,838,434 | 6/1989 | Miller | 210/221.2 |
| 4,971,685 | 11/1990 | Stanley | 210/512.1 |
| 4,997,549 | 3/1991 | Atwood | 210/221.2 |
| 5,069,751 | 12/1991 | Chamblee | 210/703 |
| 5,131,980 | 7/1992 | Chamblee | 210/703 |
| 5,173,177 | 12/1992 | Greenwood | 210/221.2 |
| 5,192,423 | 3/1993 | Duczmal | 210/221.2 |
| 5,224,604 | 7/1993 | Duczmal | 210/221.2 |

FOREIGN PATENT DOCUMENTS

| | | |
|---|---|---|
| 198737 | 11/1988 | European Pat. Off. . |
| 1168868 | 11/1958 | Fed. Rep. of Germany . |
| 2355229 | 5/1974 | Fed. Rep. of Germany . |
| 1134443 | 4/1957 | France . |
| WO90/0006-46 | 1/1990 | Sweden . |

*Primary Examiner*—Thomas M. Lithgow
*Attorney, Agent, or Firm*—Beveridge, DeGrandi, Weilacher & Young

[57] ABSTRACT

A flotation cyclone for flotation of small particles of less than 30 μm, comprising a cylinder (1) with an upper section, having a porous wall (4) and an extension (6) having a solid wall, said upper section being provided with a tangential inlet (2) and being covered with a lid, having a vortexfinder (10) as a foam outlet, and being surrounded by a gas chamber (3) having a gas inlet (3'), surrounding said porous wall (4), and being provided at the lower end of said porous wall (4) with a weir (5), while the extension (6) of said cylinder, having a solid wall, is provided at its lower end with a liquid as a blocking device.

10 Claims, 1 Drawing Sheet

FLOTATION CYCLONE

The invention relates to a flotation cyclone, more specifically a flotation cyclone for small particles of less than 30 μm, as well as entities at the molecular level, such as molecules as such as well as ions.

Though various attempts have been made for separating particles by flotation, none of these have turned out to be satisfactory for efficient flotation of small particles of less than 30 μm. The present invention provides a flotation cyclone, capable of efficient flotation of such particles as well as entities at the molecular level, such as molecules as such as well as ions.

The invention relates to a flotation cyclone comprising a cylinder, in its upper section provided with a porous wall, having a tangential inlet for a liquid with the particles to be separated, a weir at the lower end of the porous wall, and a gas chamber surrounding said porous wall. The cylinder has an extension beyond the porous wall downwards as a solid wall, provided at its lower end with water as a blocking device, which may be a bottom plate, whether or not adjustable, a cone, a float or similar.

The weir is the separation between the flotation section and the water/foam separating section of the apparatus. The water as a blocking device in said second section allows separation of foam from water. If a bottom plate is used, the cylinder will expand at its lower end to a larger width, causing water to act as a blocking device by appropriate positioning of the bottom plate.

The invention will now be elucidated with reference to the accompanying drawings without limiting the invention thereto. In the drawings:

BRIEF DESCRIPTION OF THE DRAWINGS

In the drawings identical parts are referred to by identical reference numbers.

In FIG. 1 is shown a cylinder (1) with an inlet (2) for the material to be treated.

In FIG. 2 the cylinder (1) is shown with a tangential inlet (2), a gas inlet (3'), a porous wall (4), a baffle plate or weir (5), an extension with a solid wall (6), an expansion (7) and a bottom plate (8) with a liquid outlet (9) and a vortex-finder (10).

Figure 1:
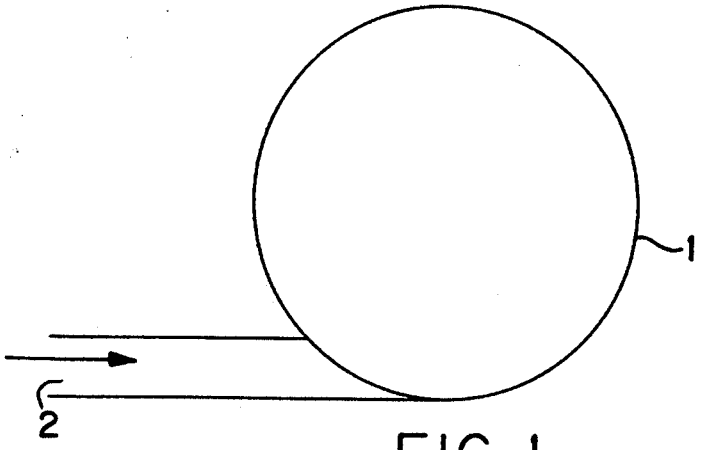
FIG. 1 shows a plan view of a flotation cyclone according to the invention.

A liquid, optionally containing a surfactant, or a surfactant, if desired, may be added elsewhere, and having suspended therein small particles (of less than 30 μm), is introduced through a tangential inlet (2) into a cylinder (1).

The cylinder (1) comprises a porous wall (4), which is surrounded by a gas-chamber (3) with an inlet (3') extending around said porous wall (4). At the bottom of the cylinder (1) is weir (5). The liquid in tangentially injected into the cylinder (1) with the porous wall (4), thus causing rotation. If desired a plurality of tangential inlets may be used. By means of the weir (5), which usually is of an annular shape, a properly controlled rotating liquid film is obtained. The angle of the weir (5) with the wall of the cylinder (1) can be a right angle, but may deviate therefrom. Through the gas-chamber (3) with the inlet (3') a gas, inert with respect to the liquid, its contents and the apparatus, is introduced through the porous wall (4), thus providing a controlled injection of gas into the film. Preferably the gas pressure and the pores in the porous wall (4) are selected such that the gas bubbles formed are in the order of 0.05–1 mm in size. If desired the gas chamber (3) may be subdivided into segments, especially if the friction of the liquid on the wall would cause a rotational velocity gradient in the axial direction.

The liquid passing the weir (5) flows into an area (11) of an extension (6) of cylinder (1), said extension (6) having a solid wall. The cylinder is first provided with an outlet member in the form of expansion housing (7), thus allowing separation of the liquid from the foam. This latter section is the liquid/foam separating section. The area (11) is provided with an adjustable bottom plate (8), thus allowing liquid to act as a blocking device. The liquid, comprising non-flotated particles, is allowed to discharge from the flotation cyclone by way of an open area (12) between the bottom plate (8) and the outmost wall of the expansion housing (7). The bottom plate (8) should be positioned in such a way that some liquid is present over the outlet openings at all times in order to prevent gas (foam) from discharging at that end. It should be observed, that the shape of the separation area (11) is not relevant, as mentioned above.

The foam created in porous cylinder (1) comprising the flotated particles therein, will fill the void area (13) of said cylinder (1). The liquid as a blocking device, caused by the bottom plate (8), causes that the foam is compelled to emerge from the flotation cyclone by way of the vortex-finder (10). The length of said vortex-finder (10) may vary from as little as the thickness of the lid up to the full length of the porous wall or even longer. The void area (13) acts as a foam draining chamber, thus increasing the selectivity of the flotation procedure.

Figure 2:
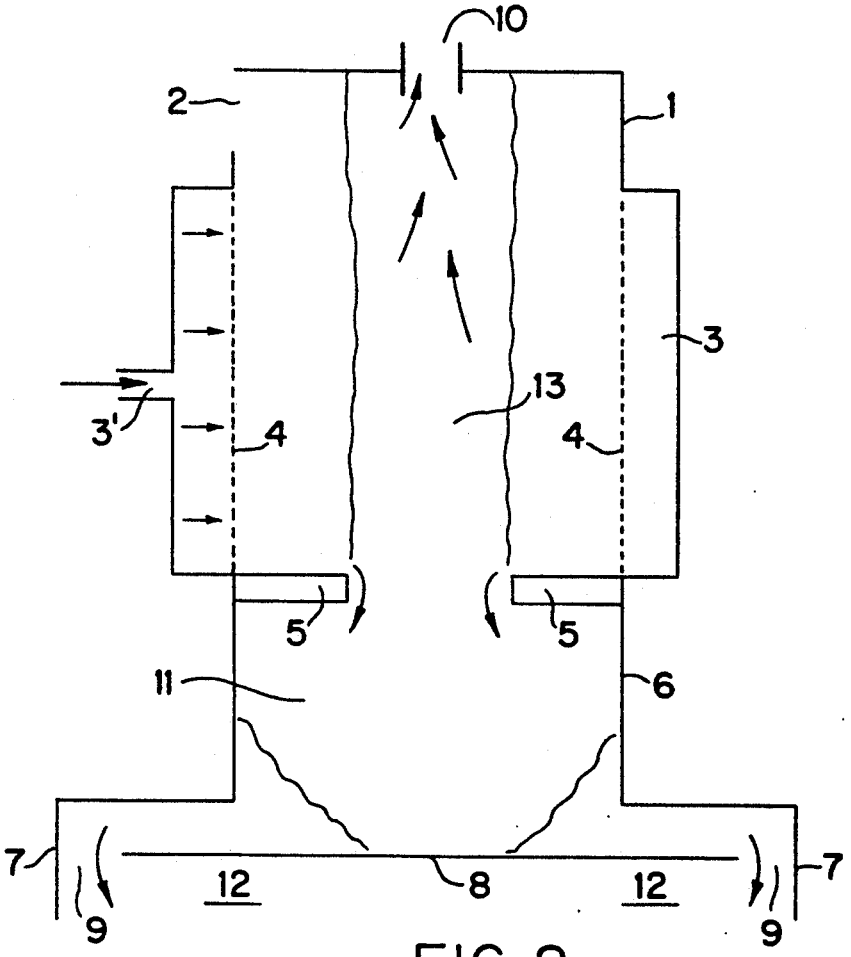
FIG. 2 shows a vertical cross-section of the flotation cyclone of FIG. 1.

The lid of the cylinder (1) is shown in FIG. 2, where the opening of the vortexfinder (10) has been omitted.

With the flotation cyclone as outlined above an improvement in the separation yield of from 10% up to 30% or even higher may be achieved.

EXAMPLE

A flotation cyclone according to the drawings was fed with a sludge containing leadsulfide (PbS) in an mount corresponding with 13000 ppm Pb. After treatment in the flotation cyclone the lead content had been removed for about 80%. In the remaining total of 40% of dry matter the concentration of Pb had been reduced to 4800 ppm Pb.

It will be obvious that the above apparatus may be modified or varied in various ways, such as for example by replacing the particles by molecules or ions, either alone or in combination without departing from the inventive concept.

I claim:

1. A flotation cyclone, comprising: p1 a flotation cylinder having a first upper end and a second lower end, said cylinder includes a tangential inlet adjacent said first end and a foam outlet in said first end which each open into an internal flotation chamber of said flotation cylinder, said flotation cylinder further including a porous wall which defines at least a portion of said internal flotation chamber, said flotation cylinder further including a wall extension with an upper end of said wall extension adjacent a lower end of said porous wall and a lower end of said wall extension defining an opening, and said flotation cylinder further comprising an outlet expansion member connected to said wall extension at said lower end;

a gas chamber housing with gas inlet, said gas chamber housing being positioned about said porous wall such that gas introduced into said gas inlet is adapted to pass through said porous wall and into the internal flotation chamber;

an annular baffle plate with an interior edge defining a central aperture and an exterior edge which is circumferentially connected to said cylinder at the lower end of said porous wall such that the interior edge is further inwardly positioned within said internal flotation chamber than said porous wall; and a bottom blocking device positioned within said outlet expansion member and spaced from the lower end of said wall extension and sized to be larger than said opening but smaller than said outlet expansion member so as to form a liquid outlet between said bottom blocking device and said outlet expansion member.

2. A flotation cyclone as recited in claim 1 wherein said outlet member includes an outlet housing and said blocking device is adjustably mounted in said housing.

3. A flotation cyclone as recited in claim 2 wherein said tangential inlet is positioned above an upper end of said porous wall and said porous wall is cylindrical in shape and said gas chamber encircles said porous wall and has an upper end commensurate with the upper end of said porous wall and a lower end commensurate with a lower end of said porous wall.

4. A flotation cyclone as recited in claim 1 wherein said baffle plate has an upper surface at a height level commensurate with the lower end of said porous wall and an exterior peripheral edge in contact with said extension wall.

5. A flotation cyclone as recited in claim 4 wherein said blocking device is a flat plate.

6. A flotation cyclone as recited in claim 1 wherein said tangential inlet is positioned above an upper end of said porous wall and said porous wall is cylindrical in shape and said gas chamber encircles said porous wall and has an upper end commensurate with the upper end of said porous wall and a lower end commensurate with a lower end of said porous wall.

7. A flotation cyclone as recited in claim 1 wherein said wall extension has an interior diameter equal to an exterior diameter of said baffle plate.

8. A flotation cyclone as recited in claim 1 wherein said diameter of said wall extension is constant from an upper end to a lower end of said wall extension.

9. A flotation cyclone as recited in claim 1 wherein said foam outlet includes a vortex finder having a central axis in common with a central axis of said internal flotation chamber.

10. A flotation cyclone as recited in claim 1 wherein said porous walls have pores dimensioned so as to produce gas bubbles in a range of 0.05 to 1 mm.

* * * * *